US007117789B2

(12) United States Patent
Bazin

(10) Patent No.: US 7,117,789 B2
(45) Date of Patent: Oct. 10, 2006

(54) METHOD FOR LOADING AND EXCHANGING THE ROLLERS OF THE PRINTING UNITS OF A PRINTING MACHINE AND DEVICE FOR WORKING THE METHOD

(75) Inventor: Rene Bazin, Farnay (FR)

(73) Assignee: Martin, (FR)

( * ) Notice: Subject to any disclaimer, the term of this patent is extended or adjusted under 35 U.S.C. 154(b) by 0 days.

(21) Appl. No.: 11/057,878

(22) Filed: Feb. 14, 2005

(65) Prior Publication Data

US 2005/0132917 A1 Jun. 23, 2005

Related U.S. Application Data

(62) Division of application No. 10/802,523, filed on Mar. 17, 2004.

(30) Foreign Application Priority Data

Mar. 18, 2003 (FR) ..... 03 03387

(51) Int. Cl.
*B41F 9/18* (2006.01)

(52) U.S. Cl. ..... 101/153; 101/174

(58) Field of Classification Search ..... 101/153, 101/216, 212, 174, 477, 486
See application file for complete search history.

(56) References Cited

U.S. PATENT DOCUMENTS 4,199,289 A * 4/1980 Segbert et al. ..... 414/347
5,074,212 A * 12/1991 Kobler et al. ..... 101/477
5,142,978 A * 9/1992 Borel ..... 101/177
5,549,044 A 8/1996 Achelpohl ..... 101/216
5,588,361 A * 12/1996 Riis ..... 101/216
6,038,972 A 3/2000 Delwiche et al. ..... 101/216
6,283,024 B1 9/2001 George ..... 101/182

FOREIGN PATENT DOCUMENTS

DE 44 20 771 A1 1/1995

* cited by examiner

*Primary Examiner*—Anthony H. Nguyen
(74) *Attorney, Agent, or Firm*—Ostrolenk, Faber, Gerb & Soffen, LLP

(57) ABSTRACT

Method for loading and exchanging the rollers of the printing units of a printing machine and a device for working the method, the device loading station including a handling carriage for engraved rollers, a storage station for rollers, a reserve station at each of the printing units, a robot for transporting the engraved rollers, either from the loading station or from the storage station to a ready position located in the reserve station. The robot takes an engraved roller either from a reserve position or from the storage station or from the loading station and brings the roller into a working position. The robot is also able to withdraw an engraved roller from its working position in order to bring it either into a reserve position, or into the storage station or into the loading station.

11 Claims, 22 Drawing Sheets

METHOD FOR LOADING AND EXCHANGING THE ROLLERS OF THE PRINTING UNITS OF A PRINTING MACHINE AND DEVICE FOR WORKING THE METHOD

CROSS REFERENCE TO RELATED APPLICATIONS

This is a divisional of U.S. patent application Ser. No. 10/802,523, filed Mar. 17, 2004 in the name of René Bazin and entitled METHOD FOR LOADING AND EXCHANGING THE ROLLERS OF THE PRINTING UNITS OF A PRINTING MACHINE AND DEVICE FOR WORKING THE METHOD.

BACKGROUND OF THE INVENTION

The present invention relates to a method for loading and exchanging the rollers of the printing units of a printing machine and to a device for working the method.

Generally, a printing machine comprises a plurality of printing units arranged one after another in the case of a flexographic printing machine in line, for example. In this kind of machines, each printing unit comprises a plate cylinder on which the ink is deposited by an engraved roller, commonly called "anilox cylinder" by workers in the art. This engraved roller is supplied with ink, in well known manner, either by means of a doctor blade chamber or an inking roller associated with an ink pan. The plate cylinder prints directly, by contact, the matter to be printed, by using a pressure roller applying the matter to be printed against the plate cylinder. The engraved rollers include, at their cirucumference, cells intended to retain the ink having to be deposited on the printing plate of the plate cylinder. The volume per surface unit of these cells varies according to the jobs to be performed. Thus, the use of different engraved rollers for each specific job to be performed will be necessary. That means that these engraved rollers have to be exchanged according to the desired printing quality, an engraved roller used for a print including large "tint blocks", i.e. large surfaces uniformly supplied with ink, will not be appropriate for fine prints not including large "tint blocks".

Exchange solutions of an engraved roller have already been proposed. One of these solutions is described in patent CH 686 355 A5. In this patent, the exchange of the engraved roller is carried out by means of a carriage comprising engraved roller supports. In order to exchange an engraved roller, this carriage is laterally introduced between two printing units and the engraved roller, having been previously withdrawn from its bearings, is brought to the level of the engraved roller supports of the carriage. The carriage can be built in various ways and include either a lifting system with cross-pieces or actuators acting directly on the vertical movement of the engraved roller supports. The engraved roller having been brought to the level of the engraved roller supports, the latter are moved to the top so as to come into contact with the engraved roller in order to support it. The carriage is then laterally withdrawn from between the printing units and brought, outside the machine, towards a processing station where the used engraved roller can be removed and replaced by a new engraved roller. The replacement of the engraved roller having been carried out, the carriage is again introduced between the printing units and the new engraved roller is placed by repeating, in the reverse order, the same operations as for its withdrawal from the printing unit. Another solution, substantially identical to that described herebefore, is described in European patent EP 0 401 636 B1.

The two above-mentioned solutions present the drawback that the operator is obliged to get in between the printing units for exchanging the engraved rollers, thus requiring his particular attention as regards his security. Another drawback lies in the fact that the exchange of the engraved rollers is a relatively long operation, during which the machine is at standstill so that its productivity is reduced accordingly.

SUMMARY OF THE INVENTION

The aim of the present invention is to eliminate the aforesaid drawbacks by proposing a method and a device for exchanging the rollers of the printing units of a printing machine in which the security of the operator is ensured in the most perfect possible way while reducing to the maximum the time necessary for the exchange operation of the engraved rollers.

To this end, the method according to the invention comprises the following stages:

a) for the loading of the engraved rollers in a storage station, in reserve stations and in a working position in the printing units:

to bring firstly, by means of a handling carriage, a first engraved roller into a loading station located at the entry of a feeder;

to bring, by means of a robot, the engraved roller, taken from the loading station, either into the storage station located in the lower part of the feeder, or into one of the reserve stations located in one of the printing units, or into an unloading position of one of the printing units;

to bring then by means of the handling carriage, previously reloaded, a second engraved roller into the loading station;

to bring, by means of the robot, the second engraved roller, taken from the loading station, either into the storage station located in the lower part of the feeder, or into one of the reserve stations located in one of the printing units;

to bring then by means of the handling carriage, previously reloaded, an umpteenth engraved roller into the loading station;

to introduce, by means of the robot, the umpteenth engraved roller, taken from the loading station, either into the storage station located in the lower part of the feeder, or into one of the reserve stations located in one of the printing units;

to introduce, by means of the robot, one of the engraved rollers taken either from the handling carriage, previously reloaded or from the storage station or from one of the reserve stations located in one of the printing units, on a transport device which will bring it into its working position, in its respective printing unit;

to position and to fix the engraved roller in its working position in its respective printing unit;

b) for the exchange of an engraved roller of one of the printing units:

to withdraw the engraved roller to be exchanged from its working position;

to bring, by means of the transport device, the engraved roller to be exchanged into an unloading position;

to bring, by means of the robot, the engraved roller to be exchanged, from the unloading position, either to a free location of the reserve station of the printing unit concerned, or to bring it, always by means of the robot, to a free location of the storage station, or to bring it, always by means of the robot, onto the handling carriage previously unloaded;

to take, by means of the robot, the engraved roller of replacement, either in the reserve station of the printing unit concerned, or in the storage station, or on the handling carriage;

to bring, by means of the robot, the engraved roller of replacement onto the transport device which will bring it into its working position and to fix the engraved roller of replacement in its working position.

The device for loading and exchanging the rollers of the printing units of a printing machine for working the foregoing method comprises a loading station, including a handling carriage for engraved rollers, followed by a storage station of engraved rollers, reserve stations arranged in each printing unit, means for transporting the engraved rollers, either from the loading station, or from the storage station to a ready position located in the reserve station of one of the printing units, the said means for transporting the engraved rollers being arranged so as to be able to take an engraved roller either from a reserve position, or from the storage station or from the loading station in order to bring it into its working position, the said means for transporting the engraved rollers being also arranged so as to be able to withdraw an engraved roller from its working position in order to bring it indifferently either into a reserve position, or into the storage station or into the loading station, and also comprises control means for said means for transporting the engraved rollers.

According to an advantageous embodiment, the means for transporting the engraved rollers consist of a transport device working conjointly with a robot.

According to another embodiment, the robot is arranged so as to be movable on rails arranged parallely between lower parts of the printing units, one of these rails including a rack in which engages a pinion of a gear box coupled with a gear motor.

According to another advantageous configuration, the robot comprises a lifting device consisting of "X" levers fixedly attached to a bedplate, the said levers supporting a base provided with support members for the engraved rollers.

BRIEF DESCRIPTION OF THE DRAWINGS

The invention will be more readily understood from the following description of an embodiment which is given by way of non-limitative example and illustrated in the accompanying drawings wherein.

DESCRIPTION OF THE PREFERRED EMBODIMENTS

Figure 1:
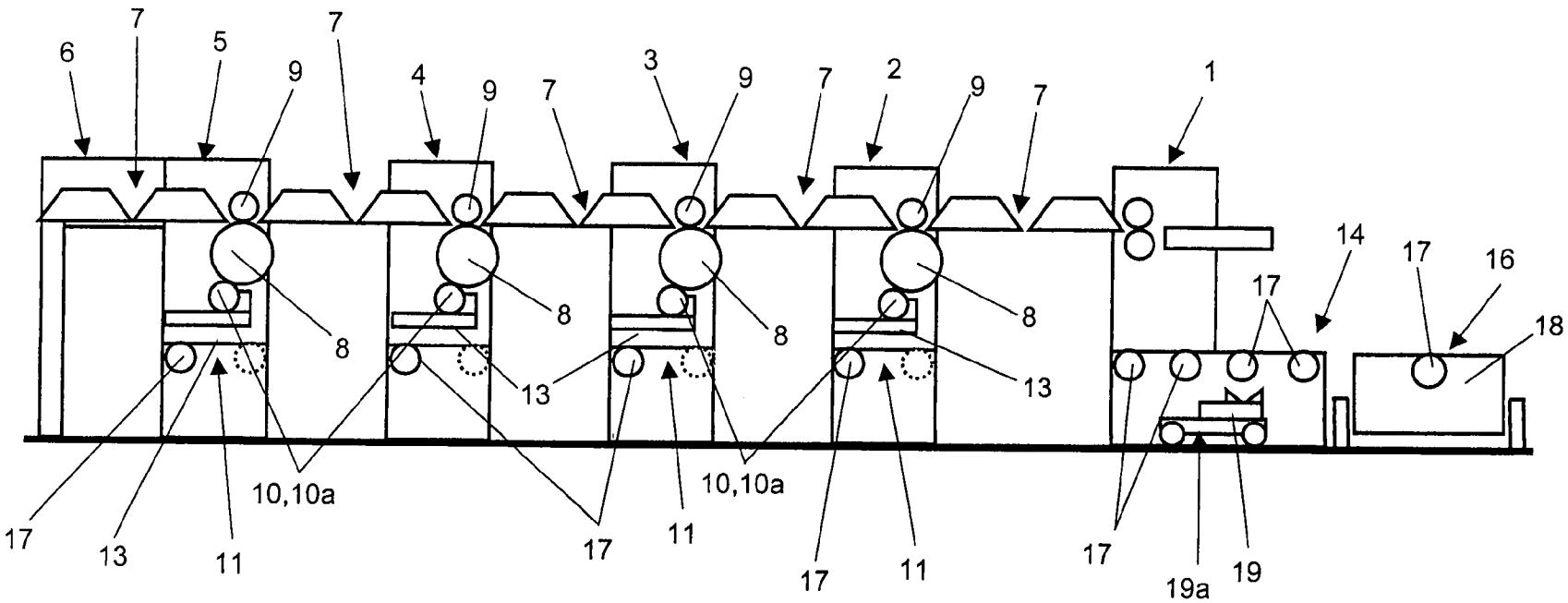
FIGS. 1 to 19 schematically illustrate the various stages of a method for exchanging the engraved rollers of a flexographic printing machine (for reasons of clearness, the reference numerals identical to those of FIG. 1 have not been indicated on FIGS. 2 to 19)

FIG. 1 schematically illustrates a flexographic printing machine comprising a feeder 1 followed by printing stations or printing units 2, 3, 4 5. The printing station 5 is as for it followed by a delivery station 6. The sheets to be printed, not shown, are conveyed through these various stations by means of suction conveyors 7. Each printing unit 2 to 5 includes a printing cylinder 8, a pressure roller 9 and an engraved or "anilox" roller 10. Each printing unit 2 to 5 also includes a reserve station 11 for engraved rollers 17. Each of these printing units 2 to 5 is also equipped with a transport device 13 for the engraved rollers 10 in operation in its respective printing unit. This transport device 13, of well known construction, can be associated with a device of engagement and release of the bearings of the engraved rollers 10, which device is also well known und thus not shown on this figure. A storage station 14 is also arranged in the lower part of the feeder 1. In the present embodiment, this storage station 14 includes locations for four engraved rollers 17. Obviously, this number is not restrictive and a number either more restricted or more important of locations for the engraved rollers in the storage station 14 would be possible. Also, the flexographic printing machine is preceded by a loading station 16 of engraved rollers 17. This loading station 16 is equipped with a handling carriage 18 which can manually or automatically be inserted in or withdrawn from this loading station 16. The flexographic printing machine shown on this figure further comprises a robot 19, shown here in the rest position 19*a*, intended for the exchange of the various engraved rollers 10 of the printing units 2 to 5. In this figure, the flexographic printing machine is shown in operation, i.e. all the engraved rollers 10 are in operating contact with their respective printing cylinders 8.

Figure 2:
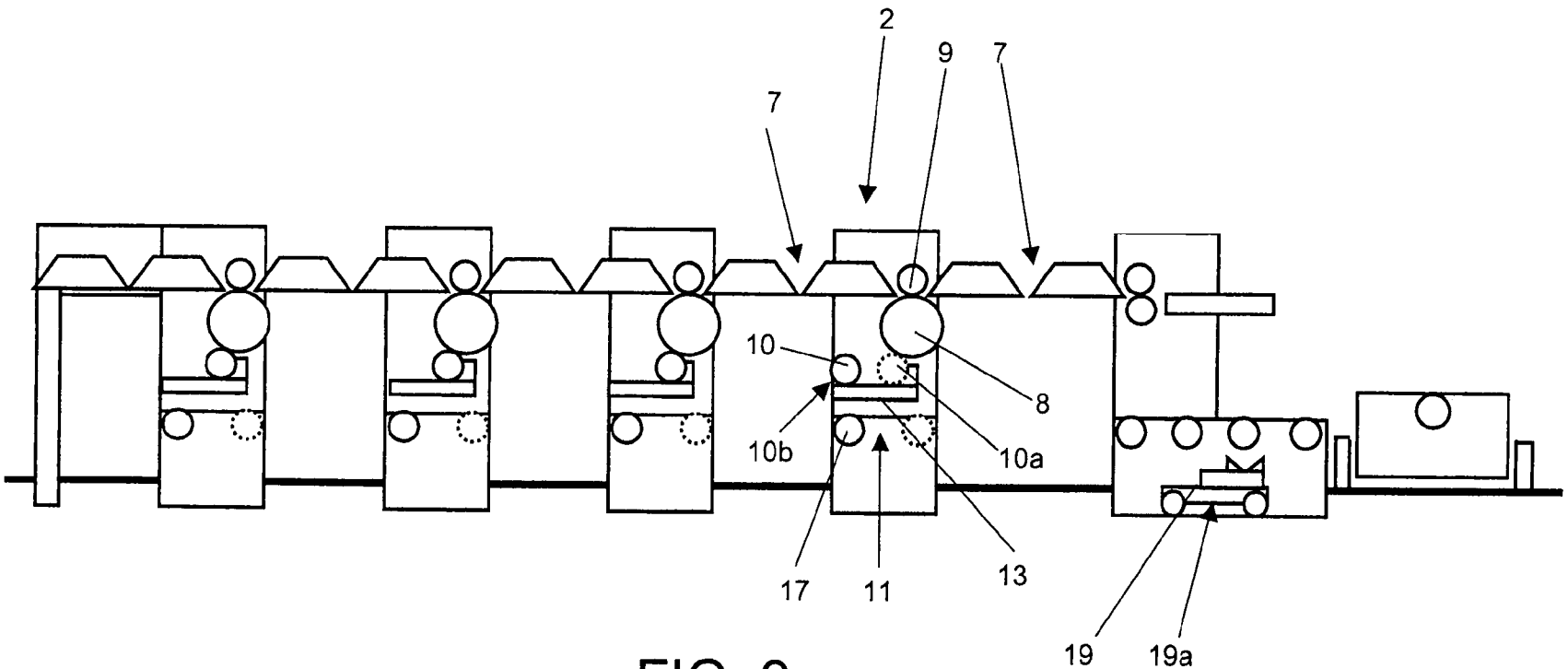

FIG. 2 illustrates the flexographic printing machine of FIG. 1 in the exchange phase of the engraved roller 10 of the printing unit 2. This exchange of the engraved roller 10 is required at the time of a job change obliging the use of an engraved roller 17 having a cell configuration more adequate than the cell configuration of the engraved roller 10 to carry out the new job. As shown in FIG. 2, the engraved roller 10, the bearings of which having been released from their housings in the side frames of the printing unit 2, either manually or automatically by means of a known device, e.g. a releasing device for bearings by unlocking and swivelling, is removed from its working position 10*a* by the transport device 13 to an unloading position 10*b*.

Figure 3:
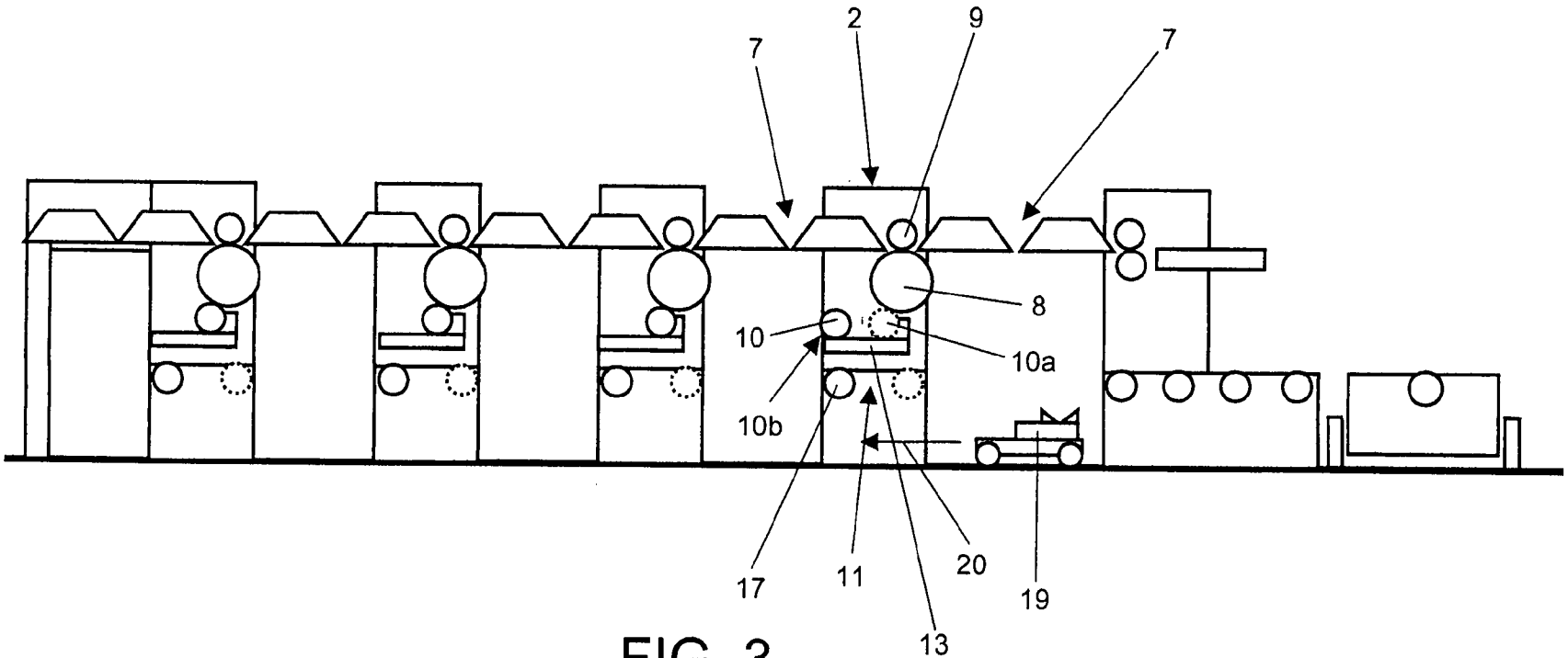

FIG. 3 illustrates one of the following stages of the exchange of the engraved roller 10, in particular the stage in which the robot 19 starts to move towards the printing unit 2, in the direction shown by arrow 20.

Figure 4:
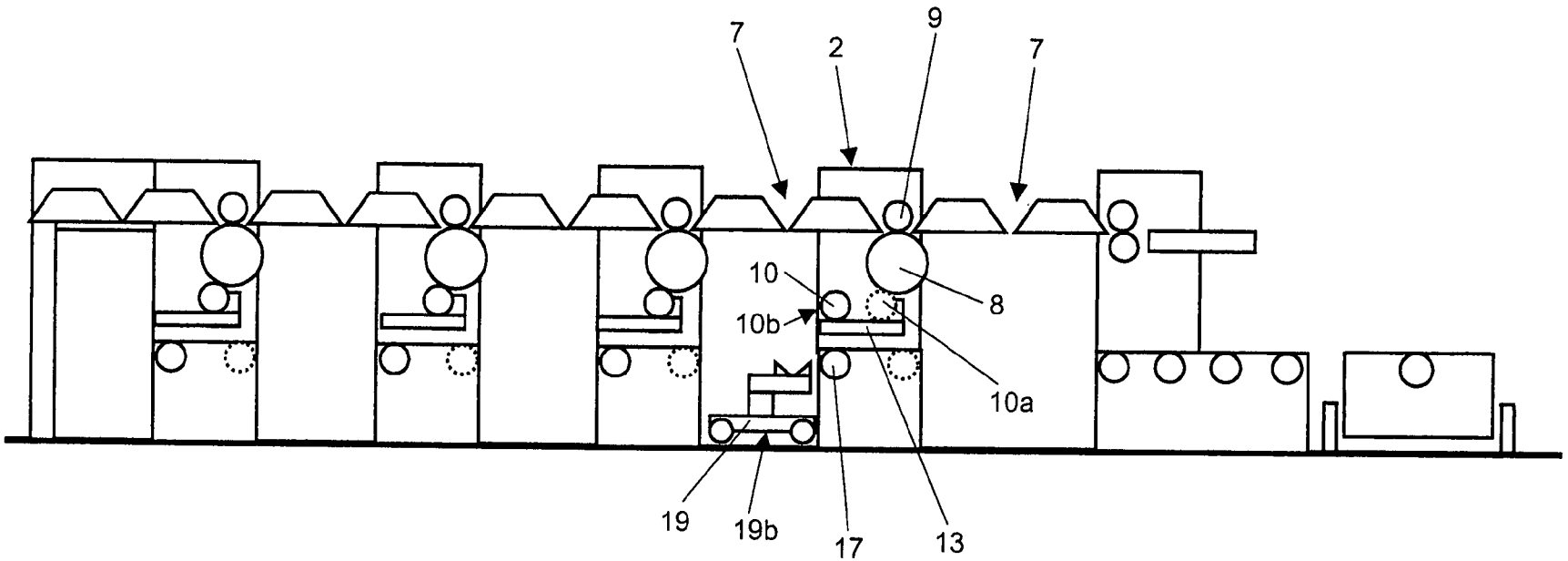

FIG. 4 shows the robot 19 which has moved so as to occupy the position 19*b* in the printing unit 2.

Figure 5:
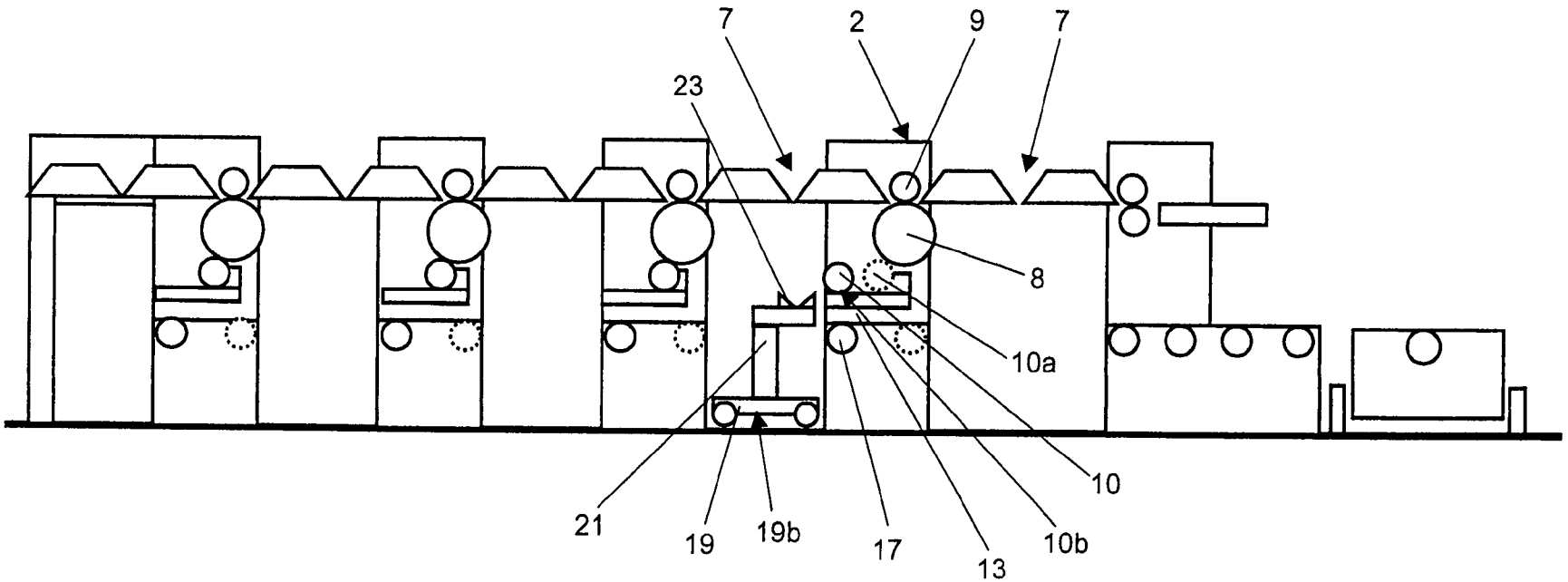
Figure 6:
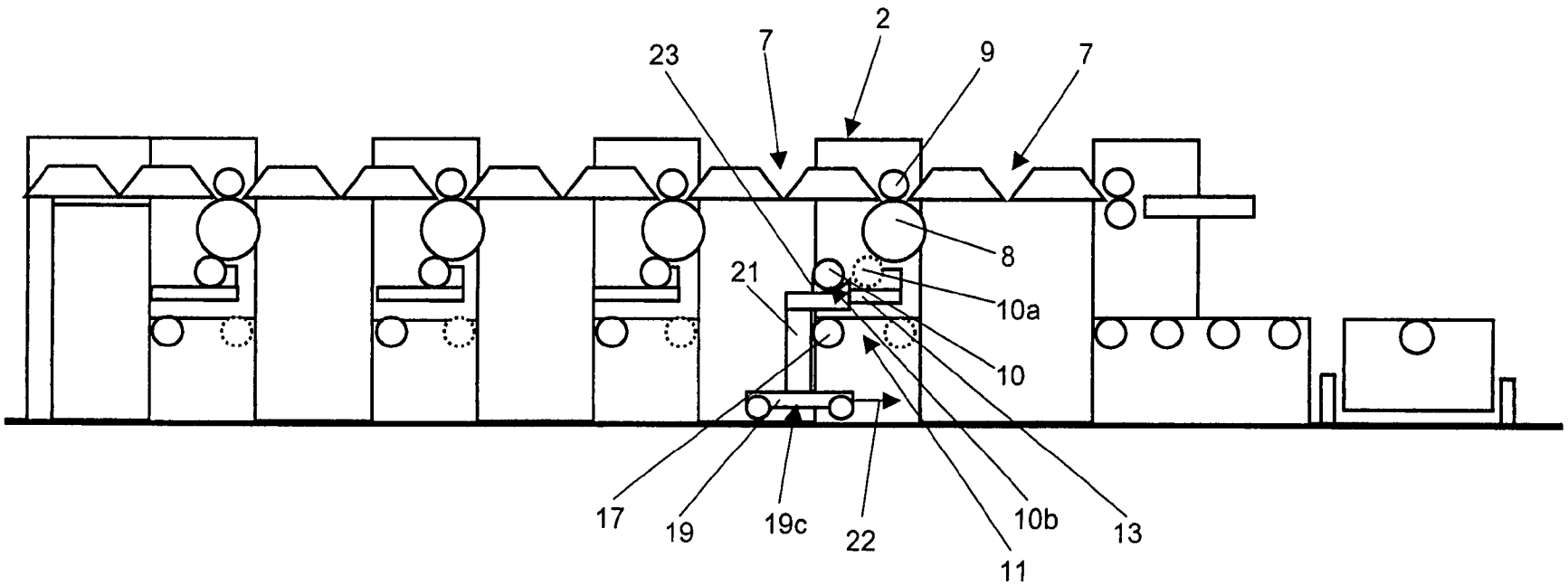
Figure 7:
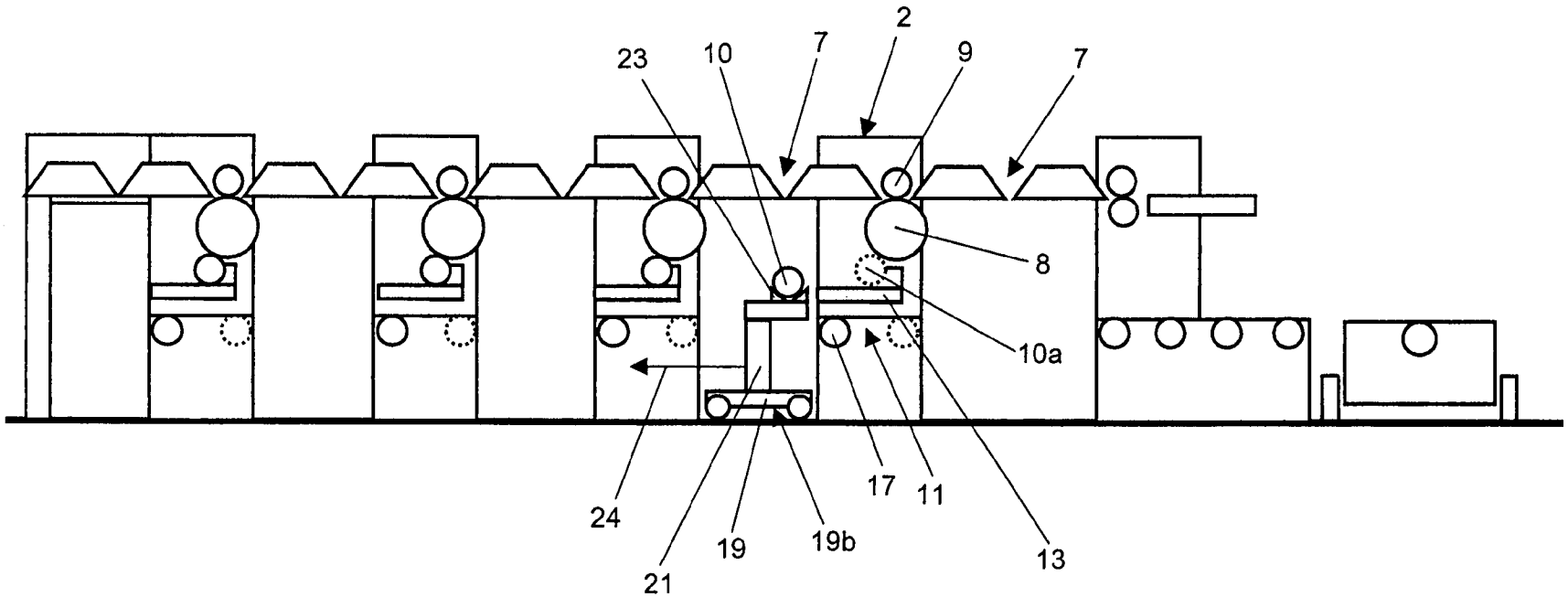
Figure 8:
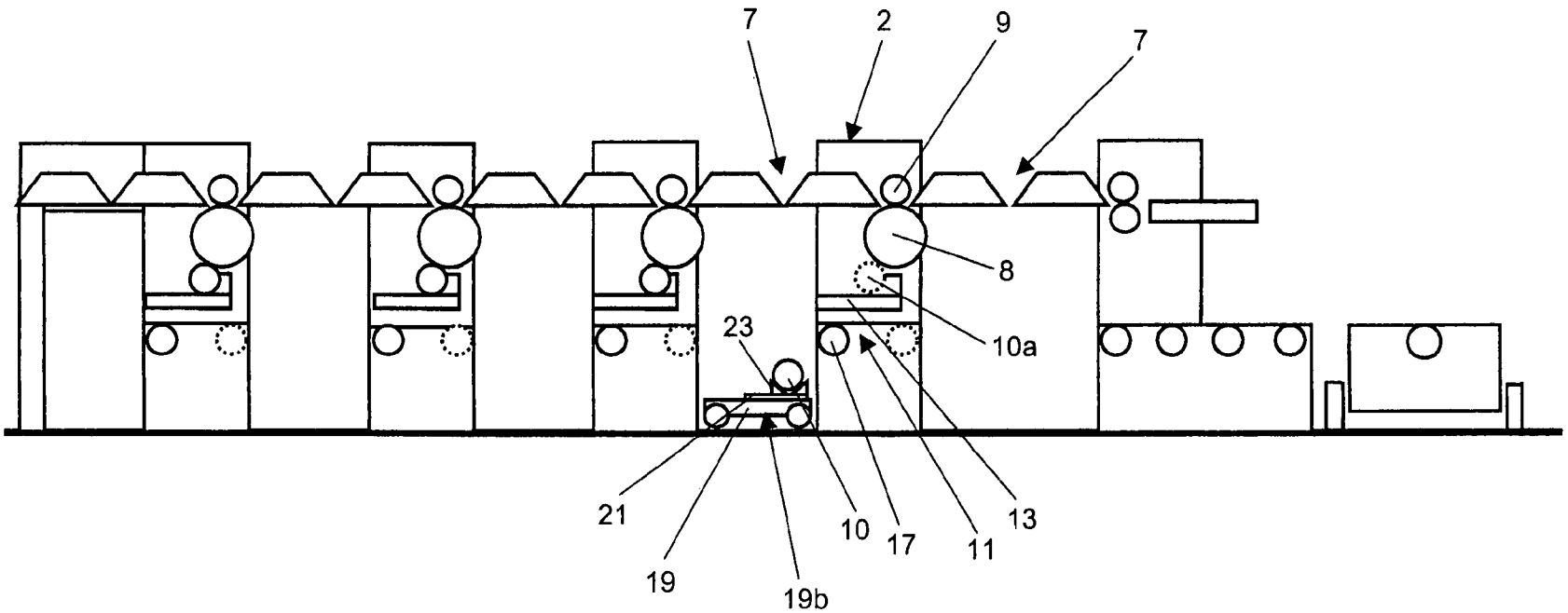

FIG. 5 represents the robot 19 in the position 19*b* after its lifting device 21 has been actuated so that its support member 23 of the engraved roller 10 comes to be placed under the lower level of the engraved roller 10. Then, as shown in FIG. 6, the robot 19 is moved in a position 19*c*, in the direction shown by arrow 22. Its lifting device 21 is again actuated so that the support member 23 is brought in contact with the engraved roller 10. The following stage consists, as shown in FIG. 7, to move the robot 19 loaded with the engraved roller 10, in the direction shown by arrow 24, to the position 19*b* which it occupied before (see also FIGS. 4 and 5). Always in this position 19*b*, the lifting device 21, supporting the engraved roller 10, is then lowered as shown in FIG. 8.

Figure 9:
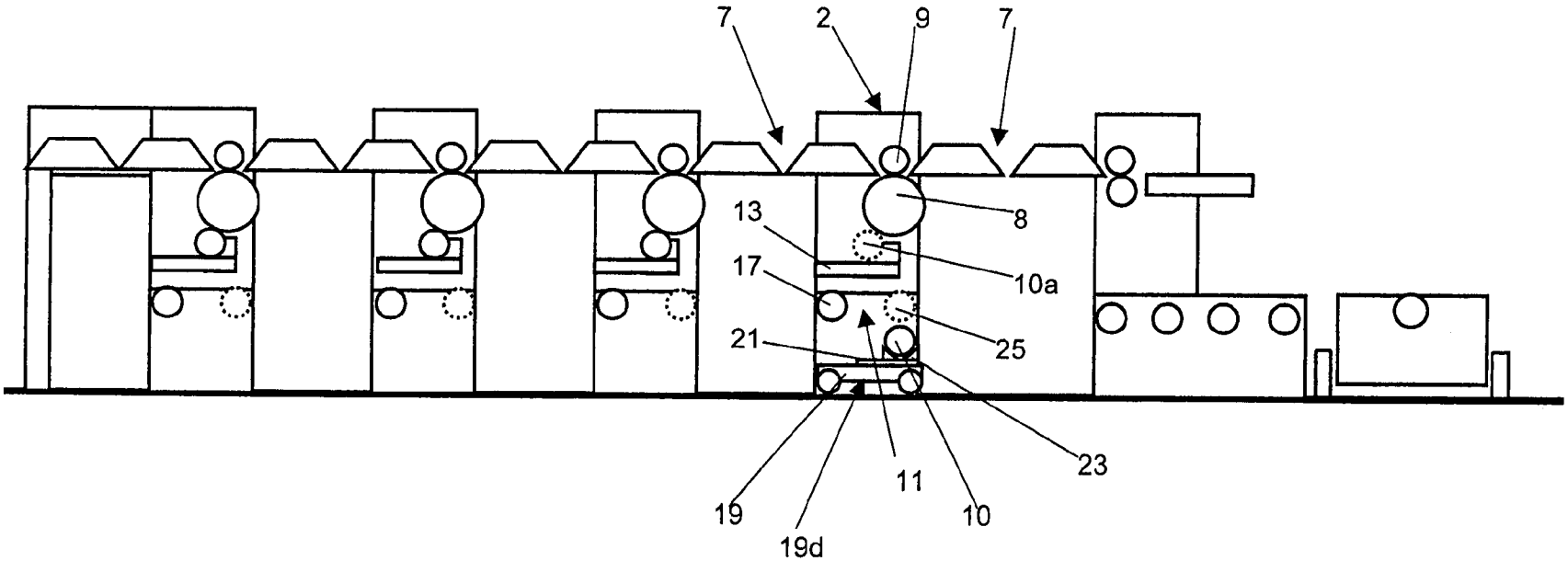
Figure 10:
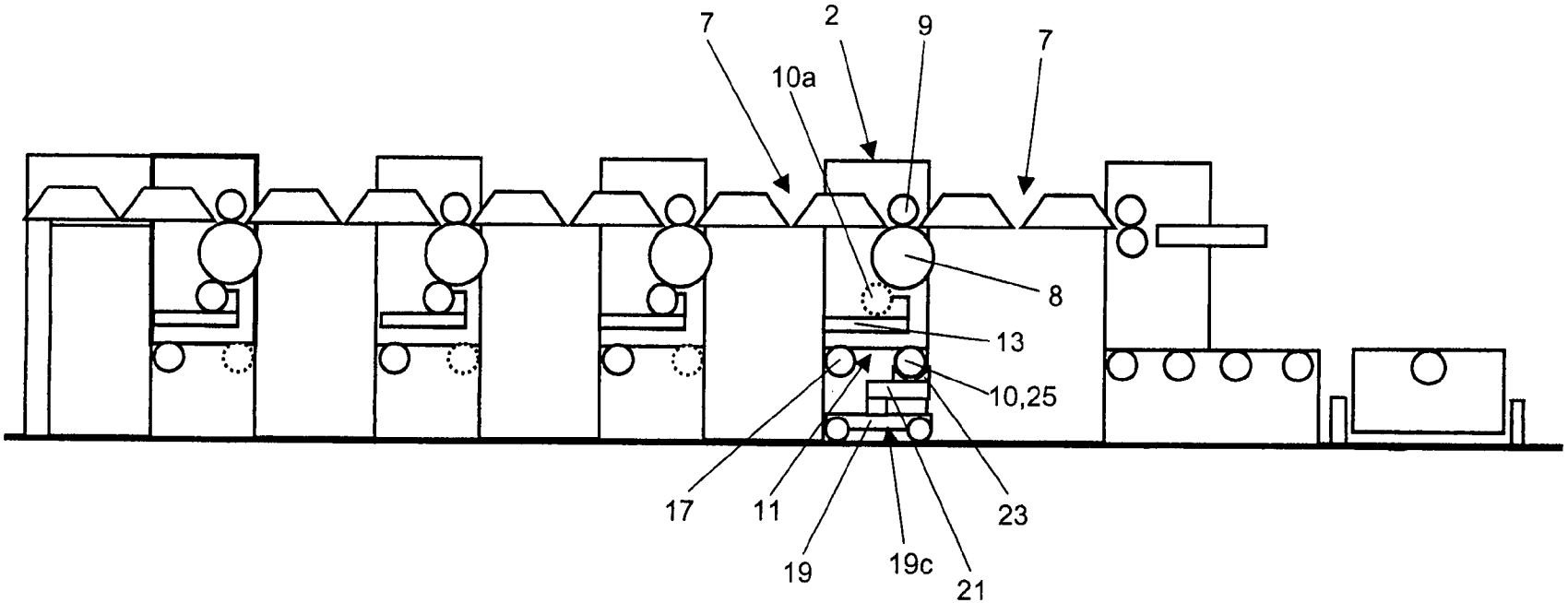

FIG. 9 represents the robot 19 in the following stage, i.e. in the position 19*d*, during which it is moved, always with its lifting device 21 in lowered position, into the printing unit 2. In this position 19*d*, the robot 19 has brought the engraved roller 10 vertically to a storage position 25 of engraved rollers located in the reserve station 11. The lifting device 21 of the robot 19 is now controlled so that it is moved vertically in the direction of the storage position 25 in which the engraved roller 10 is deposited on side supports, not shown here, of the reserve station 11. This arrangement is illustrated in FIG. 10.

Figure 11:
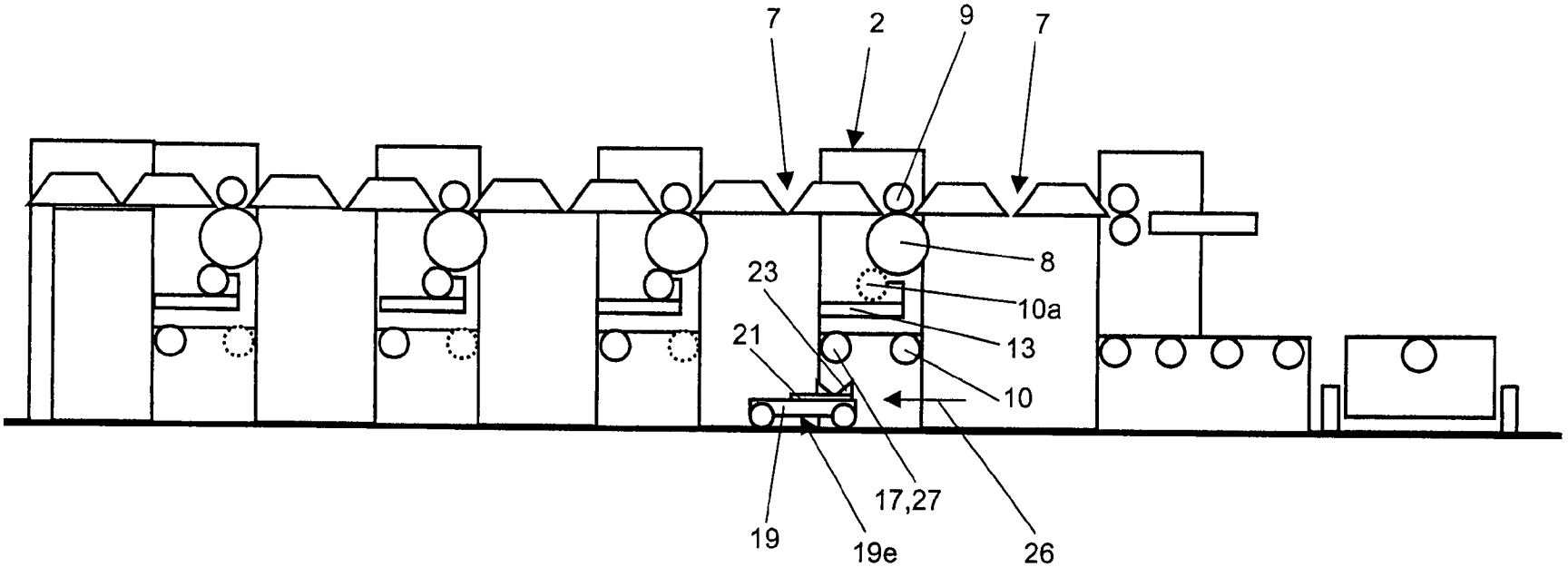
Figure 12:
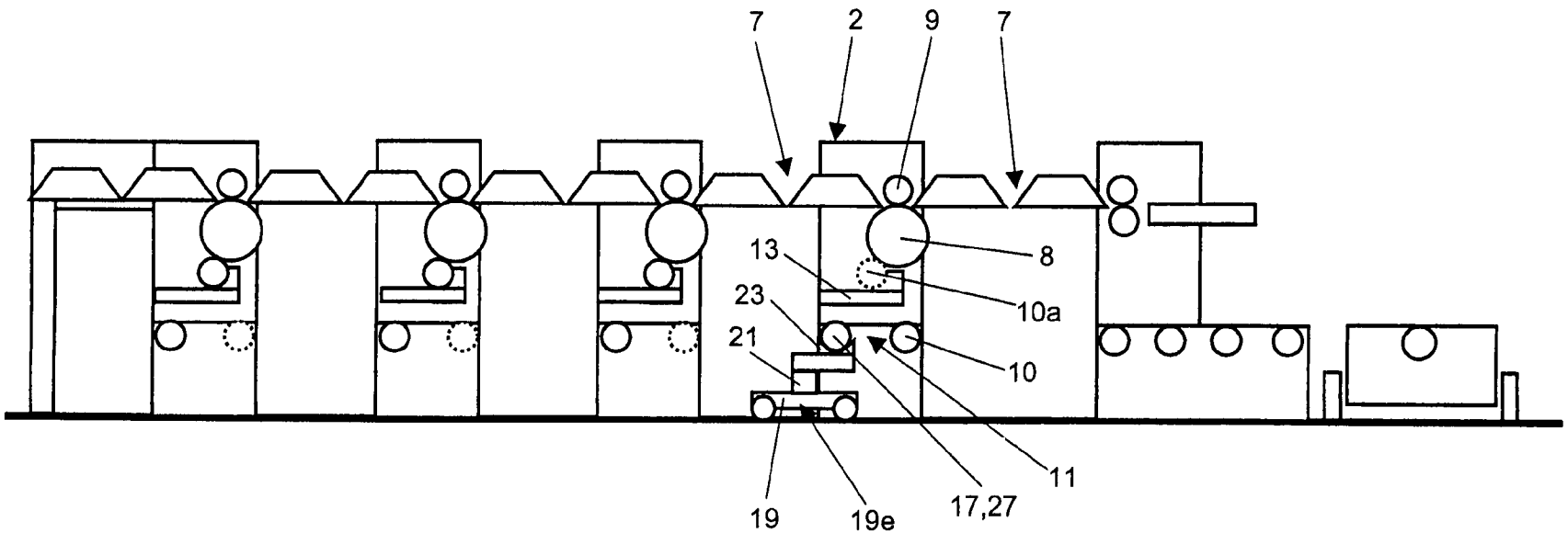
Figure 13:
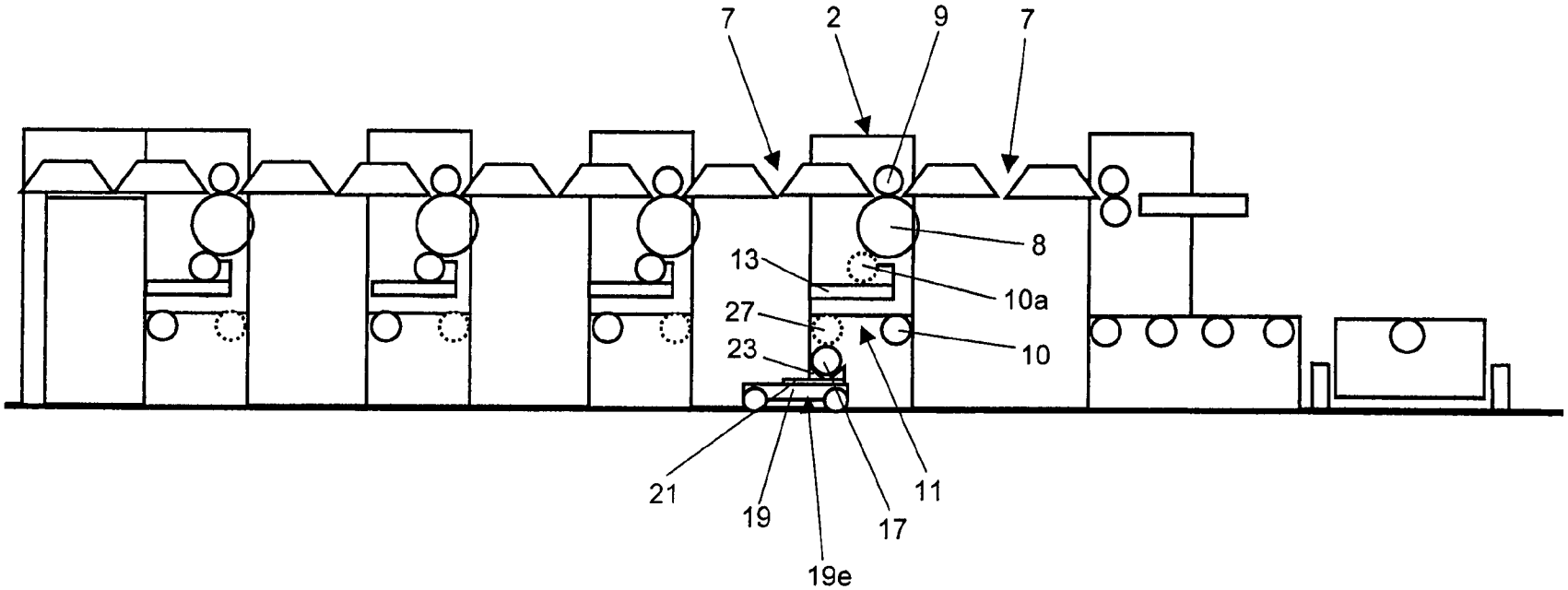
Figure 14:
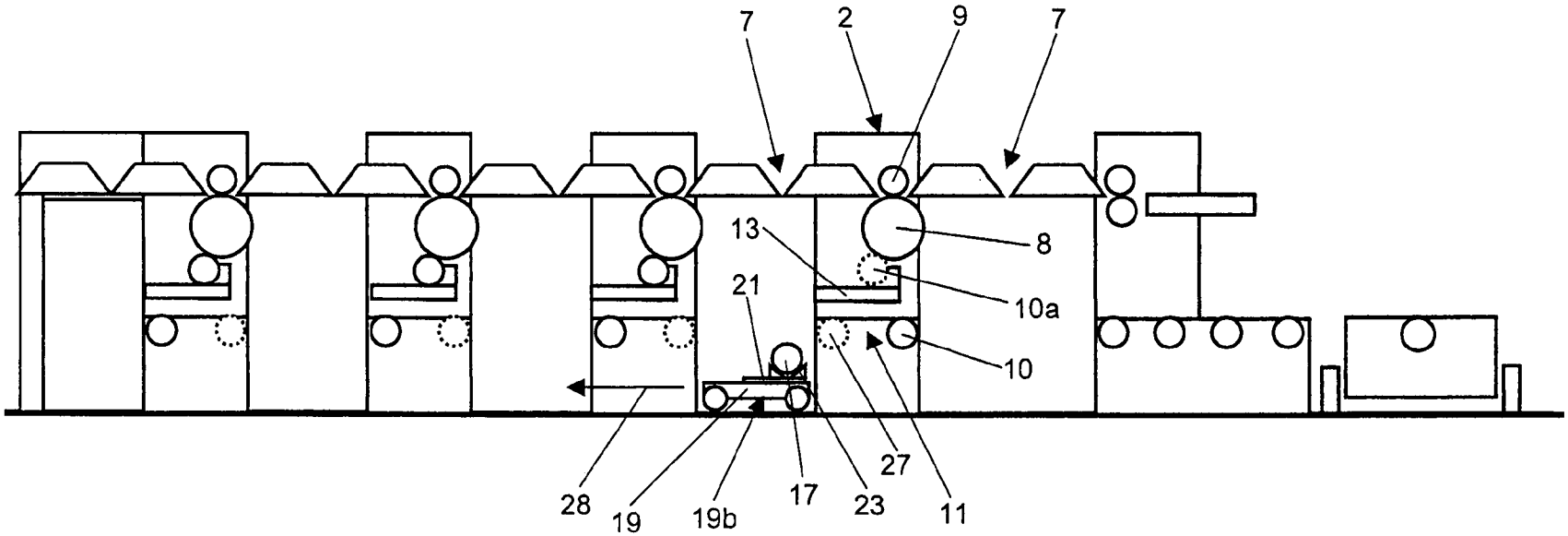
Figure 15:
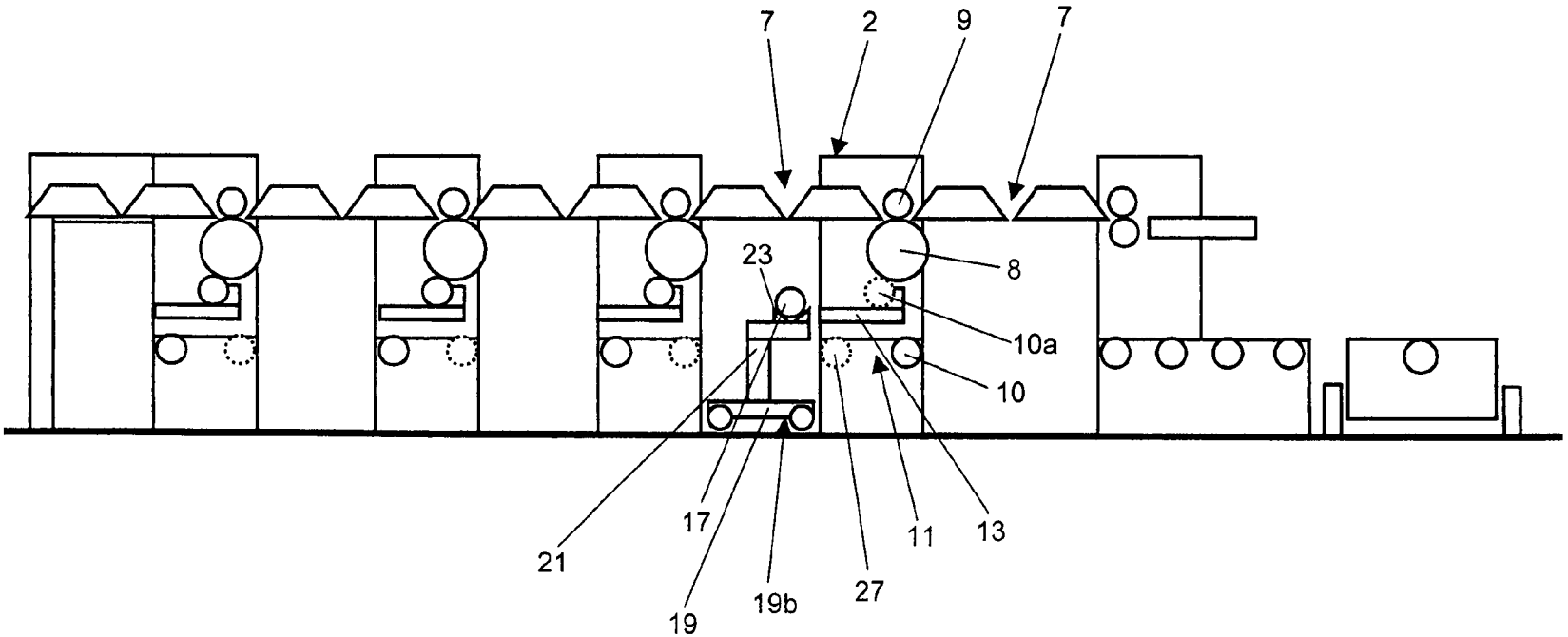

As represented on FIG. 11, the robot 19 is then moved in the direction shown by arrow 26 to a position 19*e* in which the support member 23 of the lifting device 21 is vertically to the storage location of a new engraved roller 17 intended to replace the engraved roller 10 which has been withdrawn from its working position 10*a*. Always in the position 19*e*, the lifting device 21 is controlled so as to be moved vertically towards the engraved roller 17 being in its storage position 27 in the reserve station 11, until that the support member 23 comes into contact with the engraved roller 17, as shown in FIG. 12. At this moment, the lifting device 21 supporting the engraved roller 17 is lowered (see FIG. 13) and the robot 19 is moved in the direction shown by arrow 28 (see FIG. 14) to the position 19*b* which it occupied already before at the time of the exchange operation of the engraved roller 10 (see also FIGS. 4, 5 and 8). The lifting device 21 of the robot 19 is then actuated vertically so as to bring the engraved roller 17 in the vicinity of the transport device 13, as shown in FIG. 15.

Figure 16:
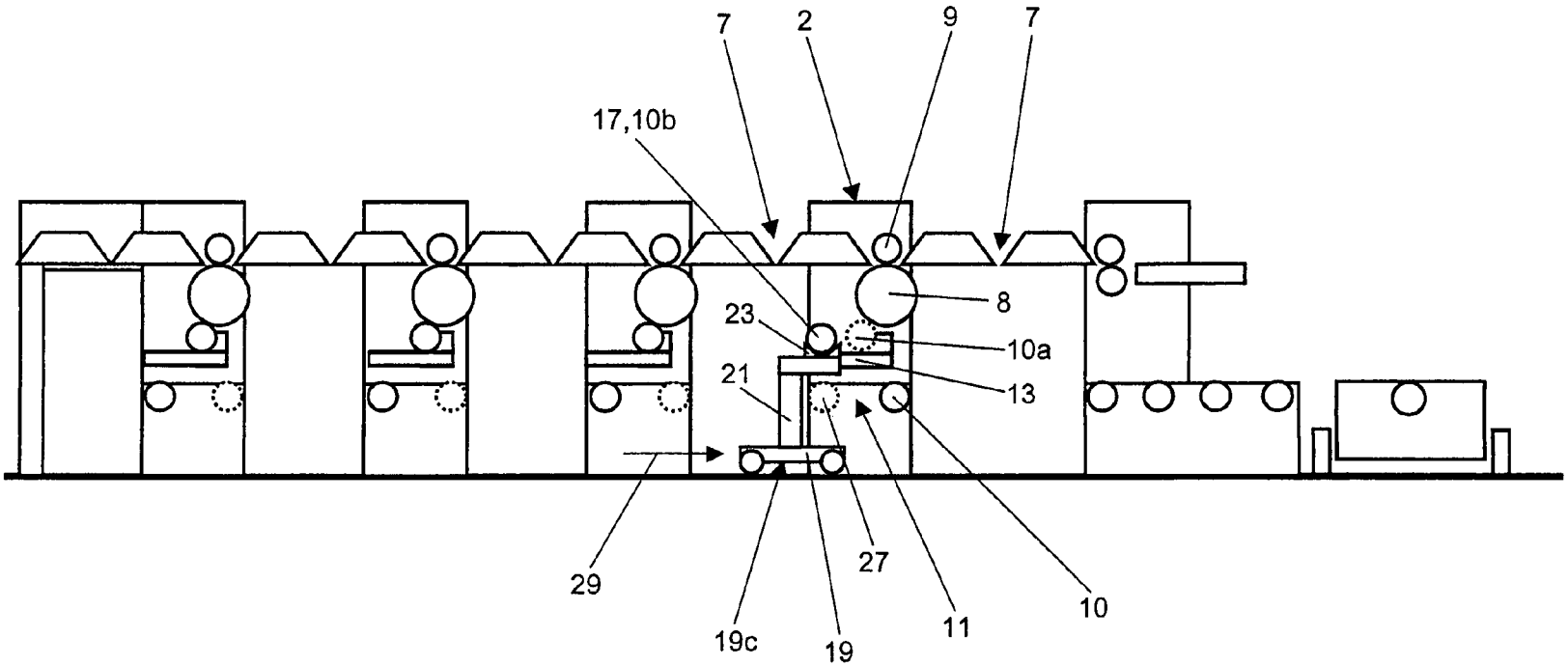
Figure 17:
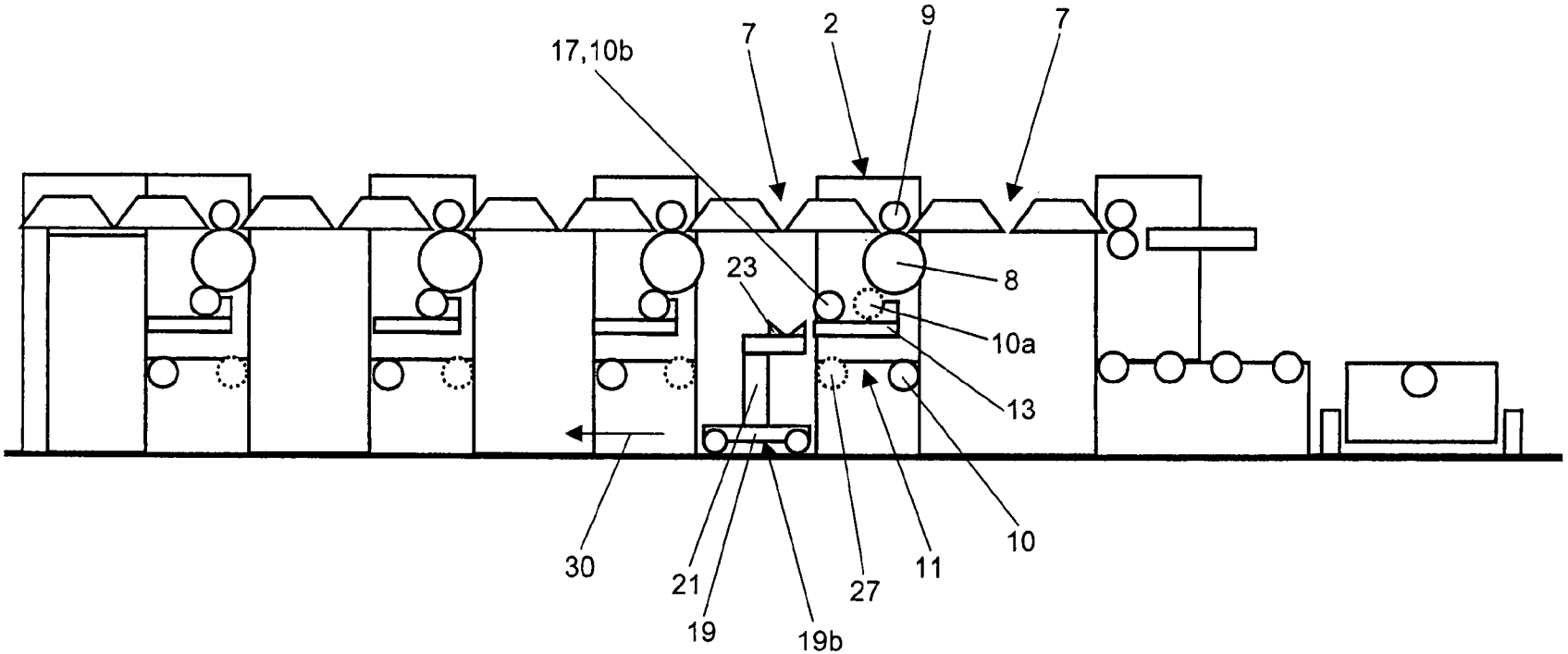
Figure 18:
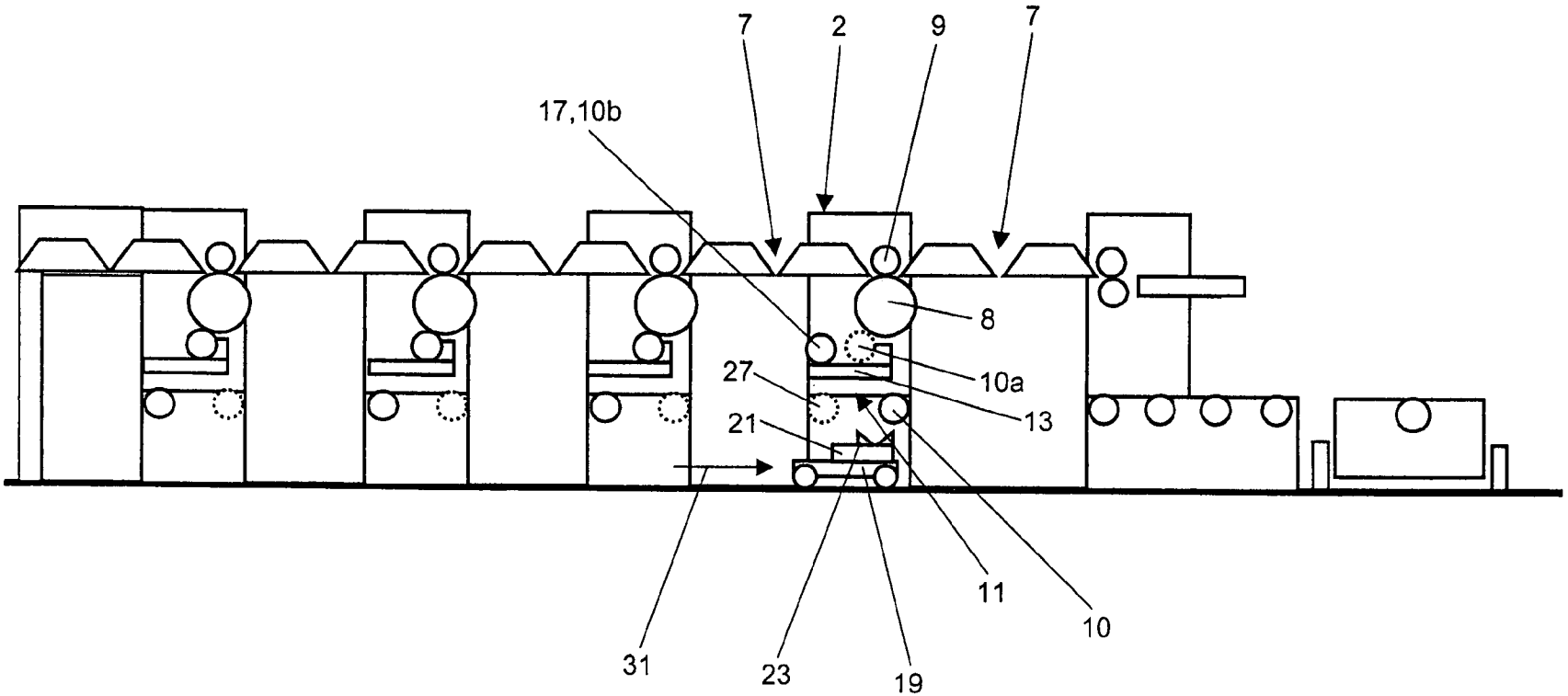
Figure 19:
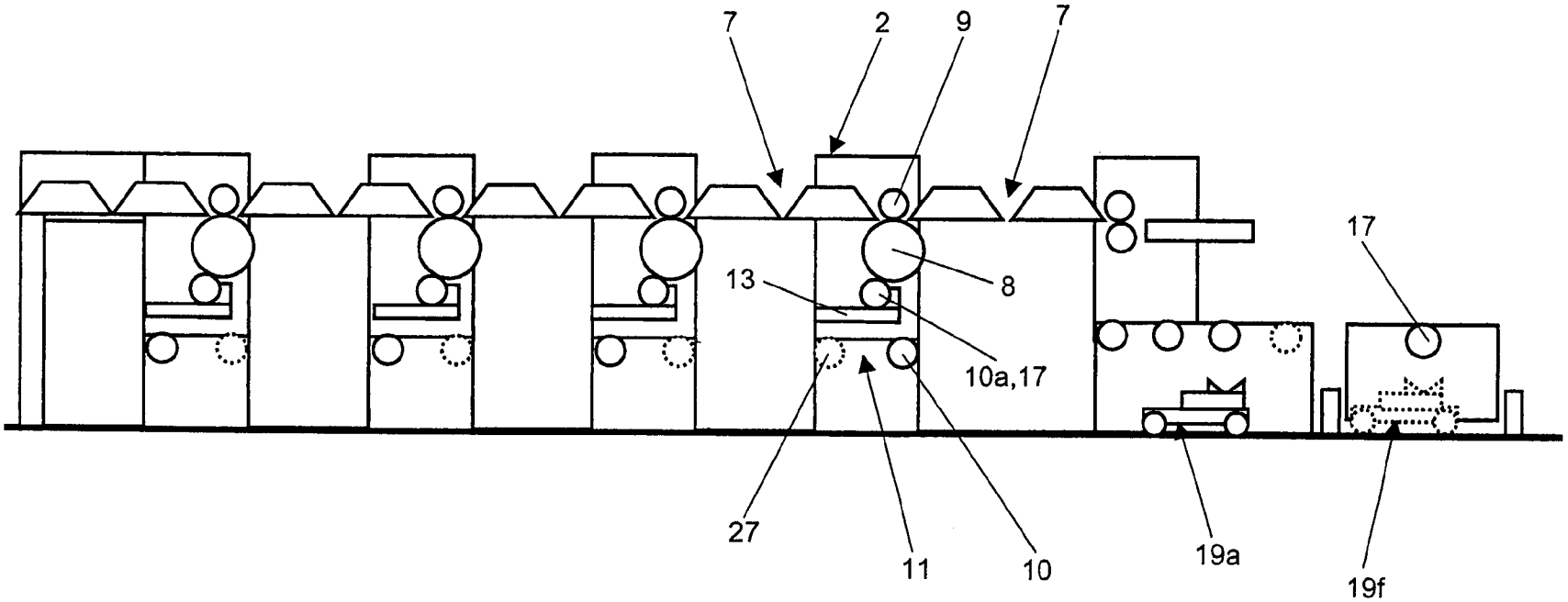

FIG. 16 shows that the robot 19 is then moved again, in the direction shown by arrow 29, to the position 19*c* which is identical to the position that it occupied in the description of FIG. 6. The engraved roller 17 is then deposited in the position 17*b* on the entry of the transport device 13. Referring now to FIG. 17, the robot 19 is moved again, in the direction shown by arrow 30, to the position 19*b* (see also FIGS. 4, 5, 7, 8, 14 and 15), then actuated downwards so as to occupy the location which it occupied in FIGS. 8 and 14. The robot 19 can then finally be moved, in the direction shown by arrow 31, to its rest position 19*a*. The replacement of the engraved roller 10 by a new engraved roller 17 in the printing unit 2 has just been described. In this operation, the new engraved roller 17 has been taken from the reserve station 11 of this printing unit 2. However, it might of course be considered, according to the inherent needs in a given job, to take a new engraved roller from any reserve station 11 of the other printing units 3 to 5 or from the storage station 14 located under the feeder 1 or even from the handling carriage 18 located in the loading station 16, by bringing the robot 19 in a position 19*f*, such as shown in short dashes on FIG. 19, so that it can take another engraved roller 17. It might also be considered to equip all the reserve stations 11 with two engraved rollers 17 and to leave free a location for engraved roller either in the storage station 14 located under the feeder 1, or on the handling carriage 18 placed in the loading station 16. In this possibility, it is obvious that the control of the robot 19 should correspond to the choice of one or the other of the solutions adopted for the exchange of the engraved rollers. In the just described example, i.e. the replacement of the engraved roller 10 of the printing unit 2 by an engraved roller 17 taken from the reserve station 11 of said printing unit, this replacement can be carried out "in masked time", i.e. without the flexographic printing machine being stopped. In this case, it is possible to carry out a job requiring only the use of the printing units 3 to 5.

An example of embodiment of a device for working the method will now be described in reference with FIGS. 20 to 22.

Figure 20:
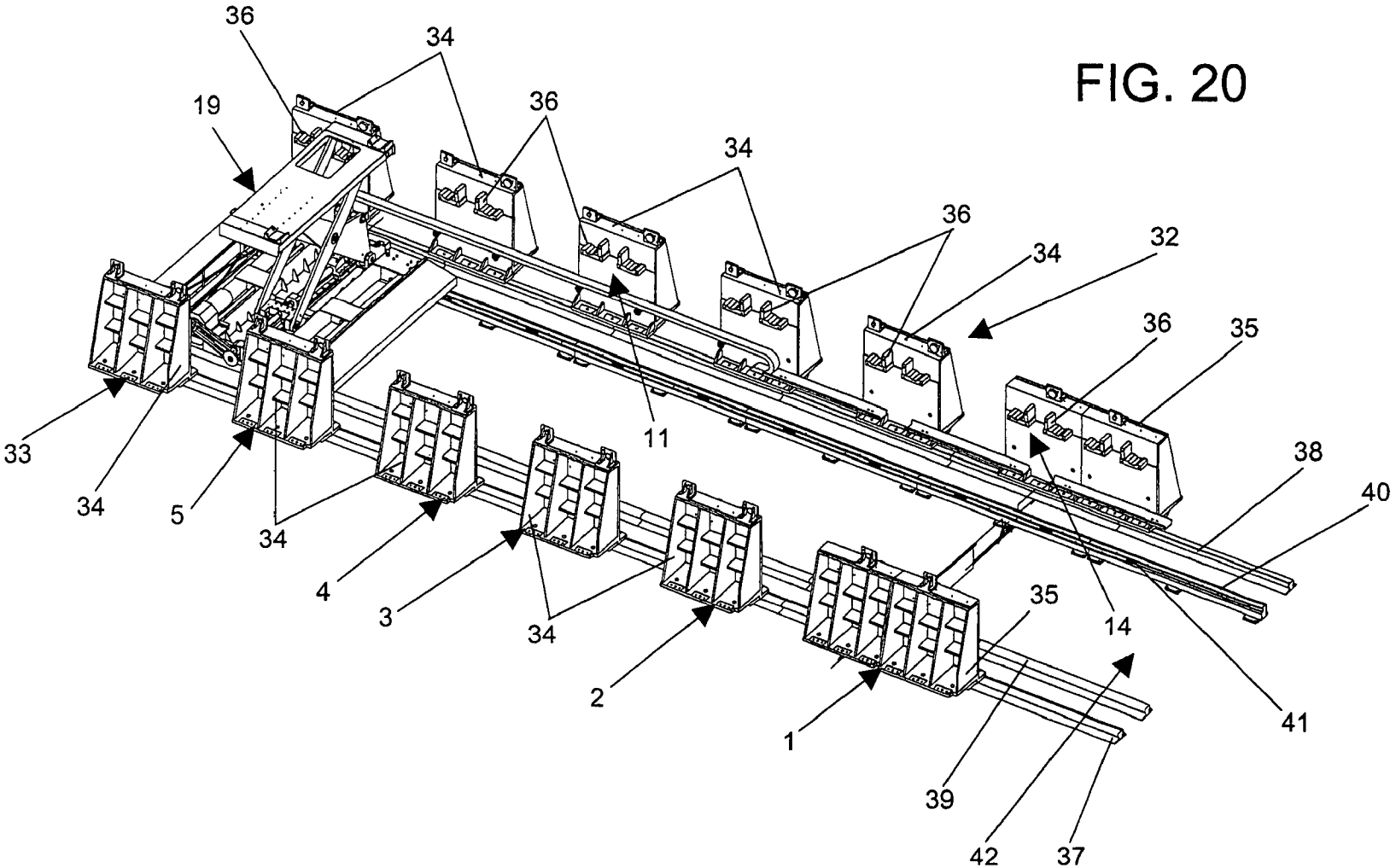
FIG. 20 is a perspective view of the lower part of a flexographic printing machine.

FIG. 20 is a perspective view of the lower part 32 of a flexographic printing machine comprising five printing units 2, 3, 4, 5 and 33 preceded by a feeder 1. Each printing unit 2, 3, 4, 5 and 33 is formed with two side frames of which only the lower parts 34 have been represented on this figure. The feeder 1 is also formed with two side frames, only the lower parts 35 of which, constituting the storage station 14, have been represented. Each lower part 34, respectively 35 is equipped with support members 36 adapted to receive the ends of the engraved rollers (not shown on this figure). In the chosen example, the lower parts 34 include each two support members 36 whereas the lower parts 35 of the storage station 14 include four. The lower parts 34, 35 are mounted on an alignment rail 37, respectively 38. The device further comprises two running rails 39 and 40, one of which, the running rail 40, being provided with a rack 41. These two running rails 39 and 40 are adapted to be used as guide for the robot 19 represented here in position in the printing unit 33. The handling carriage 18, which is not shown on the figure, will be placed in the area 42 located right before the storage station 14 arranged at the lower part of the feeder 1.

Figure 21:
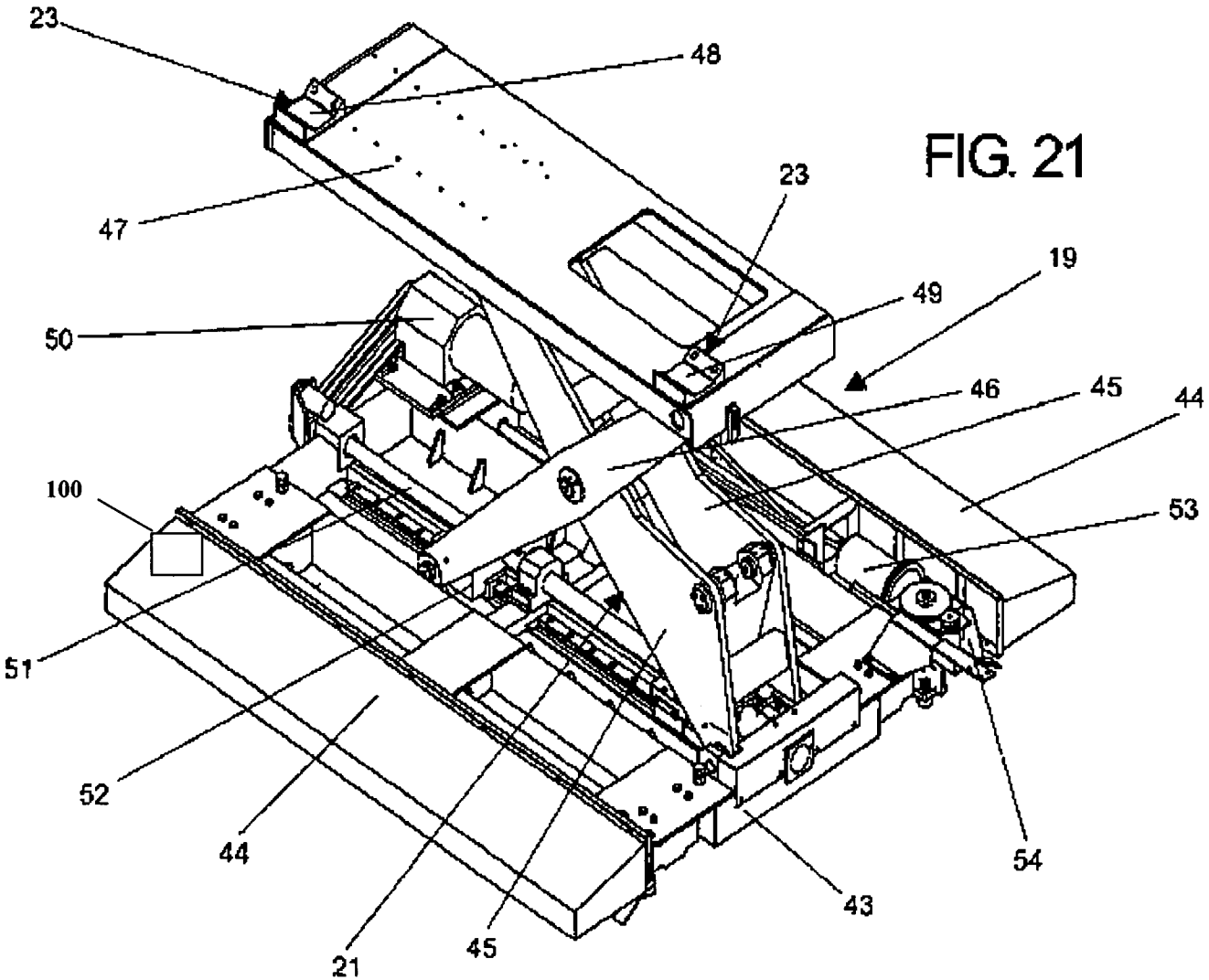
FIG. 21 is a perspective view of a member for loading and unloading the engraved rollers.

FIG. 21 is a perspective view of a loading and unloading member of engraved rollers 17, defined in this description, as being robot 19. This robot 19 consists of a bedplate 43 comprising at its front and rear parts a safety device 44. The bedplate 43 is arranged so as to support the lifting device 21 consisting of an elevator formed with "X" levers 45 and 46 supporting a base 47 on which a support member 23 for the engraved rollers is fixed. This support member 23 consists here of two parts in V 48 and 49. The elevator of the lifting device 21 is controlled by means of a motor 50 acting on a control screw 51 engaging in a nut disposed in the crossbar 52 connecting the two lower ends of the levers 46. The bedplate 43 is moreover equipped with a gear motor 53 coupled to a gear box 54 one of the pinion of which (not shown) engages within the rack 41 of the running rail 40 of FIG. 20. The control of the motor 50 of the elevator of the lifting device 21 as well as the control of the gear motor 53 intended to ensure the movement of the robot 19 are performed by means of a computer program, implemented, for example, by computer device 100, whose program steps are defined according to the various movements mentioned in connection with the description of FIGS. 1 to 19.

Figure 22:
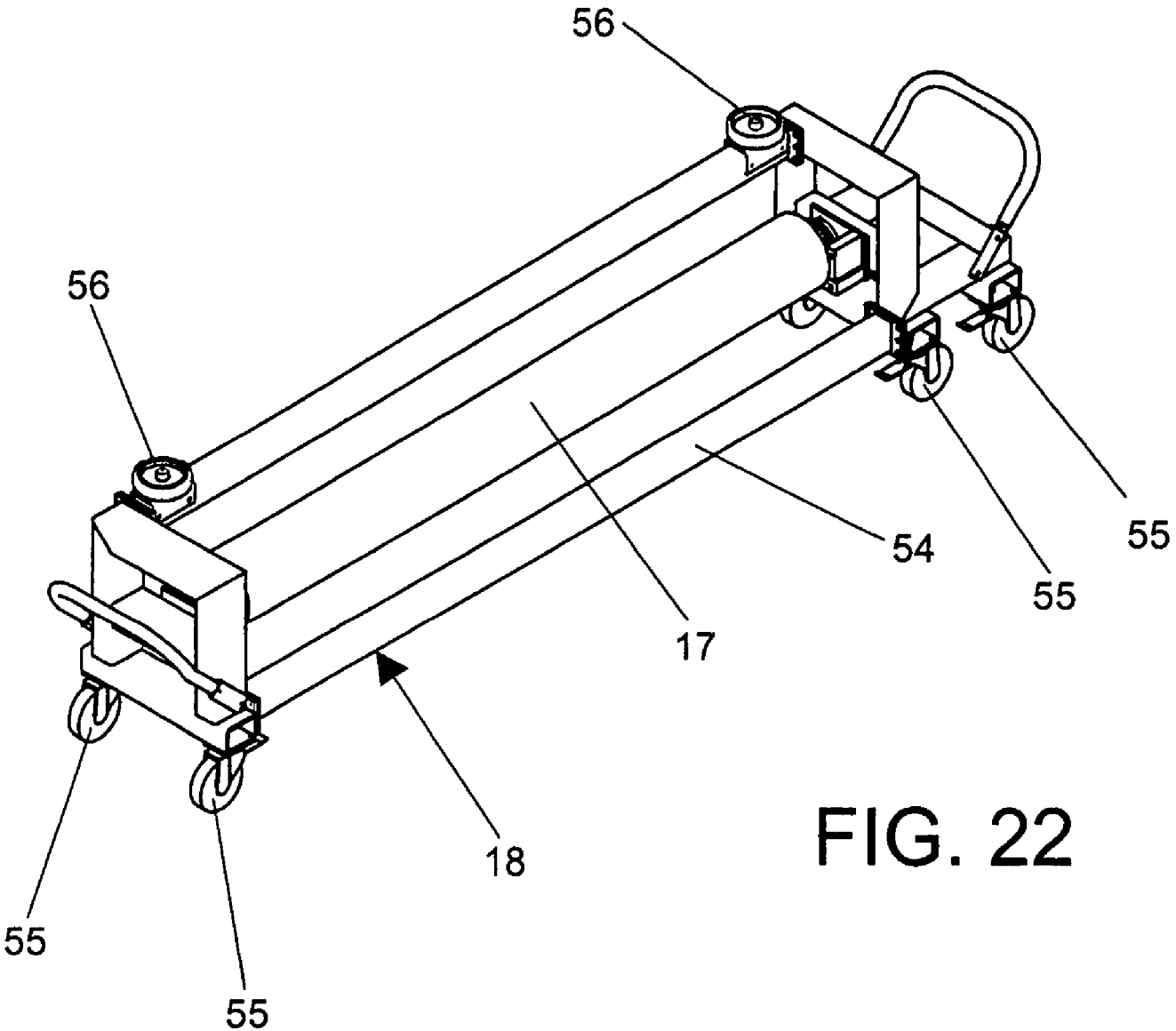
FIG. 22 is a perspective view of a handling carriage for engraved rollers.

FIG. 22 is a perspective view of a handling carriage 18 for an engraved roller 17. This handling carriage 18 consists of a frame 54 equipped with directional casters 55 as well as two centering and guiding discs 56 allowing the accurate positioning of the handling carriage 18 in the loading station 16, that on a slide (not shown) of well known manufacture comprising, for example, two guiding rails adapted to receive the two centering and guiding discs 56.

A thus composed handling carriage 18 enables the operator to move the engraved roller 17, carried by the handling carriage, towards a workstation, located outside the machine, in which various operations, for example washing operations, could be carried out.

The invention claimed is:

1. An apparatus for loading and exchanging engraved rollers of printing units of a printing machine, wherein the printing machine comprises a plurality of the printing units in succession along a path through which objects to be printed at the printing units pass, wherein the printing units are positioned in a continuous line, and the apparatus including:

a loading station for engraved rollers, the loading station preceding the printing units;

a moving device for moving a first engraved roller from the loading station to the respective printing unit;

a further device at the printing unit then operable for moving the first engraved roller to a working position at the printing unit where the first engraved roller is in a position to print an object:

the moving device additionally being operable to move among the printing units to enable withdrawal of one of the first engraved rollers from any of the printing units, and the moving device being operable for moving to the respective printing unit where a first engraved roller is to be removed, for engaging the first engraved roller to be removed and for withdrawing the first engraved roller from the working position, for moving the first engraved roller to a loading and unloading position where it may be transported and for bringing that first engraved roller into a storage location; and a control device for controlling operation of the apparatus.

2. The apparatus of claim 1, further comprising a respective reserve station for engraved rollers at each of the printing units;

the moving device being operable for holding an engraved roller and for transporting that engraved roller from a storage station to a respective reserve station at each of the printing units and also to the respective working position for the engraved roller at each of the printing units and operable for moving a first engraved roller withdrawn from its working position either into the reserve position at the respective reserve station at the printing unit or to the storage station.

3. The apparatus of claim 2, further comprising a respective transport device at each of the printing units operable for transporting a first engraved roller between a loading position and an unloading position away from the working position of the printing roller in the printing unit.

4. The apparatus of claim 3, wherein the moving device for moving the roller from the loading station to each of the printing units comprises a robot movable from the loading station selectively to each of the printing units, the control device being operably connected with the robot for causing the movement of the robot;

the robot including an engraved roller positioning device thereon, for moving an engraved roller to a position where the robot can transport the engraved roller to and past each of the printing units, and the positioning device being operable at each of the printing units to move an engraved roller at the printing unit to the loading and unloading position and then to move the roller away from the loading and unloading position to enable the robot with the engraved roller supported on the robot to move through the apparatus past the printing units.

5. The apparatus of claim 1, wherein the moving device for moving the roller from the loading station to each of the printing units comprises a robot movable from the loading station selectively to each of the printing units, the control device being operably connected with the robot for causing the movement of the robot;

the robot including an engraved roller positioning device thereon, for moving an engraved roller to a position where the robot can transport the engraved roller to and past each of the printing units, and the positioning device being operable at each of the printing units to move an engraved roller at the printing unit to the loading and unloading position and then to move the roller away from the loading and unloading position to enable the robot with the engraved roller supported on the robot to move through the apparatus past the printing units.

6. The apparatus of claim 5, further comprising a guide rail extending from the loading station past each of the printing units, and the robot including a cooperating guide element such that the robot is movable along the rail.

7. The apparatus of claim 6, wherein each of the printing units has a lower part located under the loading and unloading position for the engraved rollers and under the working position thereof, and the rail passes beneath the loading and unloading positions and the working positions of the printing units for transporting an engraved roller below those positions and to the printing units.

8. The apparatus of claim 7, wherein the rail includes a rack, a driven pinion gear on the robot with a motor drive to the pinion gear to move the robot along the rack.

9. The apparatus of claim 6, wherein the robot includes a lifting device operable on the robot for lifting the engraved roller supported on the lifting device between the loading and unloading position at the printing unit and a lowered position selected so that the robot may move the engraved roller to and past the respective printing unit.

10. The apparatus of claim 9, wherein the positioning device on the robot is comprised of a pair of levers in X form and a bedplate on which the levers are supported, a base in turn supported by the levers including support elements on the base for the engraved rollers, and a drive on the robot for moving the X form levers to selectively raise and lower support elements for the engraved roller moving device.

11. An apparatus for loading and exchanging engraved rollers of printing units of a printing machine, wherein the printing machine comprises a plurality of the printing units in succession along a path through which objects to be printed at the printing units pass, wherein the printing units are positioned in a continuous line, and the apparatus including:

a loading station for engraved rollers, the loading station preceding the printing units;

a moving device for moving a first engraved roller from the loading station to the respective printing unit;

a further device at the printing unit then operable for moving the first engraved roller to a working position at the printing unit where the first engraved roller is in a position to print an object:

the moving device additionally being operable to move among the printing units to enable withdrawal of one of the first engraved rollers from every printing unit, and the moving device being operable for moving to the respective printing unit where a first engraved roller is to be removed, for engaging the first engraved roller to be removed and for withdrawing the first engraved roller from the working position, for moving the first engraved roller to a loading and unloading position where it may be transported and for bringing that first engraved roller into a storage location; and a control device for controlling operation of the apparatus.

* * * * *